US006568912B2

(12) United States Patent
Röhner

(10) Patent No.: US 6,568,912 B2
(45) Date of Patent: May 27, 2003

(54) METHOD AND A DEVICE FOR MEASURING THE PUMP OPERATING PARAMETERS OF A DIAPHRAGM DELIVERY UNIT

(75) Inventor: Gerhard Röhner, Hemsbach (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/859,873

(22) Filed: May 17, 2001

(65) Prior Publication Data

US 2002/0006335 A1 Jan. 17, 2002

(30) Foreign Application Priority Data

May 18, 2000 (DE) ..... 100 24 116

(51) Int. Cl.[7] ..... F04B 19/24; F04B 49/00
(52) U.S. Cl. ..... 417/53; 417/63; 417/383
(58) Field of Search ..... 417/53, 63, 383

(56) References Cited

U.S. PATENT DOCUMENTS 4,610,256 A * 9/1986 Wallace ..... 600/486
4,781,535 A * 11/1988 Frawley et al. ..... 340/605
5,560,279 A * 10/1996 Connors et al. ..... 417/63
6,279,402 B1 * 8/2001 Fisher ..... 73/754

FOREIGN PATENT DOCUMENTS

WO 95/06205 3/1995

* cited by examiner

*Primary Examiner*—Charles G. Freay
*Assistant Examiner*—Michael K. Gray
(74) *Attorney, Agent, or Firm*—Kenyon & Kenyon

(57) ABSTRACT

A method for measuring the pumping operating parameters of a diaphragm delivery unit, the conductivity of a resistance device mounted on a diaphragm being measured, at least over one pumping period, as a time-dependent quantity, and this quantity being used in the measurement.

11 Claims, 4 Drawing Sheets

METHOD AND A DEVICE FOR MEASURING THE PUMP OPERATING PARAMETERS OF A DIAPHRAGM DELIVERY UNIT

BACKGROUND OF THE INVENTION

The present invention relates to a method and a device for measuring the pump operating parameters of a diaphragm delivery unit.

RELATED ART

In many areas where diaphragm pumps are used, it is necessary to be able to measure the pump operating parameters using measuring techniques. If the delivery unit is used for toxic or flammable liquids, then strict safety requirements must be satisfied. The operativeness of these systems is usually monitored by a process control system. In the event of a malfunction, the system switches over to a standby delivery circuit. The goal is to be able to detect a failure of the pump as early as possible. The diaphragm of a diaphragm delivery unit is the component having the highest failure rate. It is subject to periodic cyclical stress over its entire service life.

For predicting a malfunction of a pump diaphragm, it is proposed in WO 95/06205 to use an electrically conductive fiber made of polytetrafluoroethylene. It is embedded in a diaphragm layer made of the same material and acts as a measuring transducer. The fiber is disposed on the diaphragm such that it essentially covers the entire shaped surface of the diaphragm in the form of a spiral or a double spiral. The ends of the fiber are led out to the edge and are connected to an electrical measuring device. The measuring device measures the ohmic resistance of the fiber. As soon as the diaphragm layer shows evidence of fatigue or cracks, this is communicated to the fiber. The result is a tearing at the fiber and a consequence of this is a change in the conductivity of the fiber, which is detected by the measuring device. In this way, using this measuring transducer embedded in a diaphragm layer, a crack or an incipient break in the diaphragm can be detected using measuring techniques. The disadvantage is that it is very expensive to manufacture the conductive plastic fiber, as well as to embed it in the diaphragm layer. Also disadvantageous is the fact that the electrical conductivity only changes slightly as a result of expansion. The practical evaluation of the measuring signal therefore is limited to confirming damage. Only the intactness of the diaphragm can be established.

PRESENTATION OF THE INVENTION

The present invention is based on the objective of creating a method and a device which permit the pump operating parameters of a diaphragm delivery unit to be measured.

In the method according to the present invention, the conductivity of a resistance device mounted on a diaphragm is measured as a time-dependant quantity through one pumping period, and this quantity is used in the measurement. In a device for carrying out the method, the technical problem underlying the present invention is solved by mounting an elastomer conductive loop on a diaphragm of a diaphragm delivery unit and by connecting it in a bridge arm of a Wheatston bridge and/or in series to a shunt, a change in the operating state of the diaphragm bringing about a temporal change in the measuring voltage in the bridge arm or at the shunt.

In one embodiment, the invention includes a method for measuring the pump operating parameters of a diaphragm delivery unit wherein the conductivity of a resistance device mounted on a diaphragm is measured at least over one pumping period as a time-dependent quantity and this quantity is used in the measurement. In another embodiment, the resistance device is constituted by an elastomer conductive loop, wherein the elastomer conductive loop is connected in at least one bridge arm of a Wheatston bridge, and the time-dependent quantity is obtained from a measuring voltage in the diagonal arm of the Wheatston bridge. In another embodiment, the elastomer conductive loop is connected in series to a shunt, and the time dependent quantity is obtained from the measuring voltage at the shunt. In yet another embodiment, the time-dependent quantity is obtained by forming an average value and is used for monitoring the diaphragm for damage.

The present invention is based on the idea of arranging a resistive measuring transducer on a diaphragm such that the momentary operating state of the diaphragm can be measured by the temporal curve of the conductivity. The measuring signal obtained in this manner then reflects the momentary operating state actually predominating on the diaphragm. The conductivity of this resistance device characteristically changes over each pump cycle as a function of load and stroke. When the diaphragm expands, the resistance device expands. As a result of this expansion, the device experiences a change in its length along with a simultaneous reduction in its cross section. This geometric change in the resistance device is proportionate to the electrical resistance of the measuring transducer, i.e., in response to an expansion, the resistance increases. Using an evaluating electronics, it is possible from this time-dependent quantity to measure such pump operating parameters as pumping frequency, number of pumping cycles, dynamic pressure curve in the delivery chamber, as well as the position of the neutral phases of the pump diaphragm. Evaluating the measuring signal, in conjunction with a process control system, makes possible a reliable monitoring of the functioning of the diaphragm delivery unit and therefore of the parts of a process that are critical for safety. For example, if the diaphragm is operated mechanically by a drive flange, it is also possible to detect a malfunction in which the drive is active but the connection between the diaphragm and the drive flange has long since been severed. Using an appropriate device for processing the measuring data, it is also possible to record operating states that occurred in the past.

It is advantageous if the resistance device is formed by a surface conductive loop which is made of a conductive plastic. Materials of this type can be impressed onto the surface of a diaphragm layer in a simple manner using screen printing. In an electrically conductive elastomer, its conductivity can be predetermined by the quantity of electrically conductive fillers. Especially well-suited for a resistance device is a surface conductive loop made of an electrically conductive elastomer. The material of this elastomer conductive loop has a specific electrical resistance of less than 300 ohm/cm. The elastomer conductive loop can be manufactured in a simple manner by adding conductive soot or conductive graphite to the elastomer as a filler. In this manner, the sensor does not function so as to generate interference in response to a motion of the rubbery-elastic diaphragm plate. The measuring transducer can be designed so that its tensile strength lies between 8 and 25 $N/mm^2$, its elongation at break lies between 50 to 400%, and the specific resistance in this context is less than 300 ohm/cm. Compared with other conductive plastics, such as are used for electrically conductive floors, the electrical resistance of the elastomer conductive loop is low. In this resistance range, a change in the conductivity is easy to measure.

It is advantageous to connect the surface conductive loop in at least one bridge arm of a Wheatston bridge and to obtain the time-dependent quantity in the diagonal arm of the bridge. In this manner, the pump operating parameters can be measured with great sensitivity.

A very simple measuring arrangement is obtained if the surface conductive loop is connected in series to a voltage source and to a shunt, and if the time-dependent quantity is obtained by measuring the voltage drop in the shunt.

During the operation of the pump, the time-dependent quantity is a pulsating quantity having a periodic curve. The measuring quantity is made up of a steady component, onto which an alternating component is superimposed. The pumping frequency can be measured in a simple manner by measuring the pumping frequency from the alternating component of the measuring signal, for example, using a bistable flip-flop.

From the alternating component of the time-dependent quantity, the delivery pressure can also be measured. The elastomer conductive loop is in contact with the diaphragm and is bonded to it. Both are rubbery-elastic and have similar mechanical properties. An expansion in the diaphragm brings about, as a consequence, an expansion in the elastomer conductive loop to the same degree. Thus the momentary value of expansion in the diaphragm corresponds to the momentarily predominating delivering pressure in the working chamber of the pump. From this signal, together with the pump frequency, a process control system can calculate the delivery performance, i.e., a quantitative stress placed on the diaphragm in the past. In this manner, it is possible to determine a favorable time for a diaphragm change. In addition, of course, operating parameters such as dynamic pressure curve, pumping frequency, number of cycles during one operating time of a long-duration recording are also available.

The monitoring of the diaphragm for damage can take place in a simple manner by generating an average value for the time-dependent quantity. Through comparison with a preestablished threshold value, a diaphragm break can be signaled.

BRIEF DESCRIPTION OF THE DRAWINGS

The present invention is described in greater detail below on the basis of several embodiments depicted in the drawings. The following are the contents.

EXECUTION OF THE INVENTION

Figure 1:
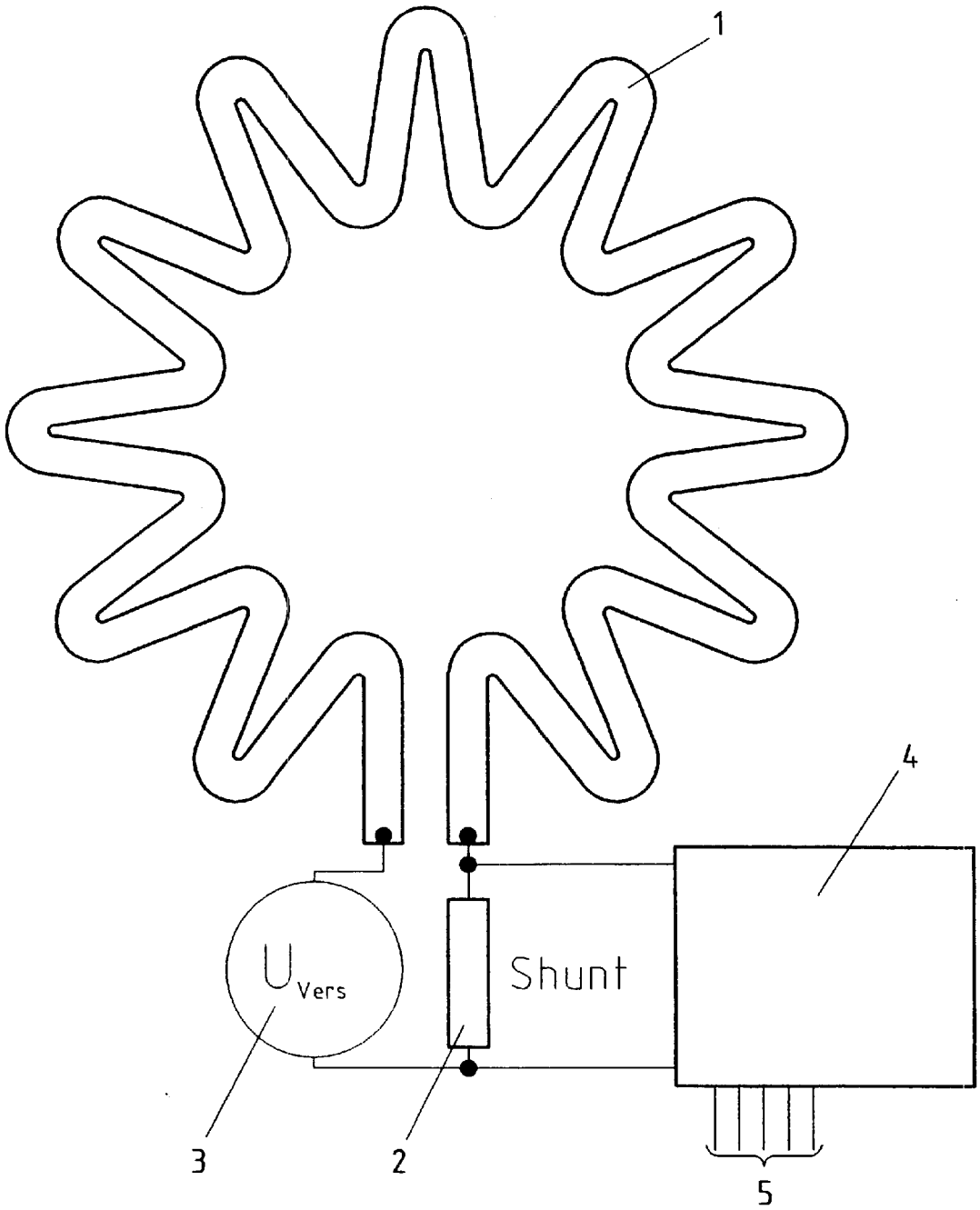
FIG. 1 depicts a preferred embodiment of a device for carrying out the method for measuring the pump operating parameters of a diaphragm delivery unit.

FIG. 1 depicts one preferred embodiment of the device according to the present invention. An elastomer conductive loop 1 is connected in series to a voltage source 3 and a measuring resistor, a shunt 2. The elastomer conductive loop is schematically sketched as a meander element. The meander is executed so that it covers the shaped area of the diaphragm. The time-dependent quantity is measured as a voltage drop at shunt 2. For processing the measuring data, an evaluating electronics 4 is connected, on the one hand, to shunt 2, and, on the other hand, via connecting lines 5 to an undepicted process control system.

Figure 2:
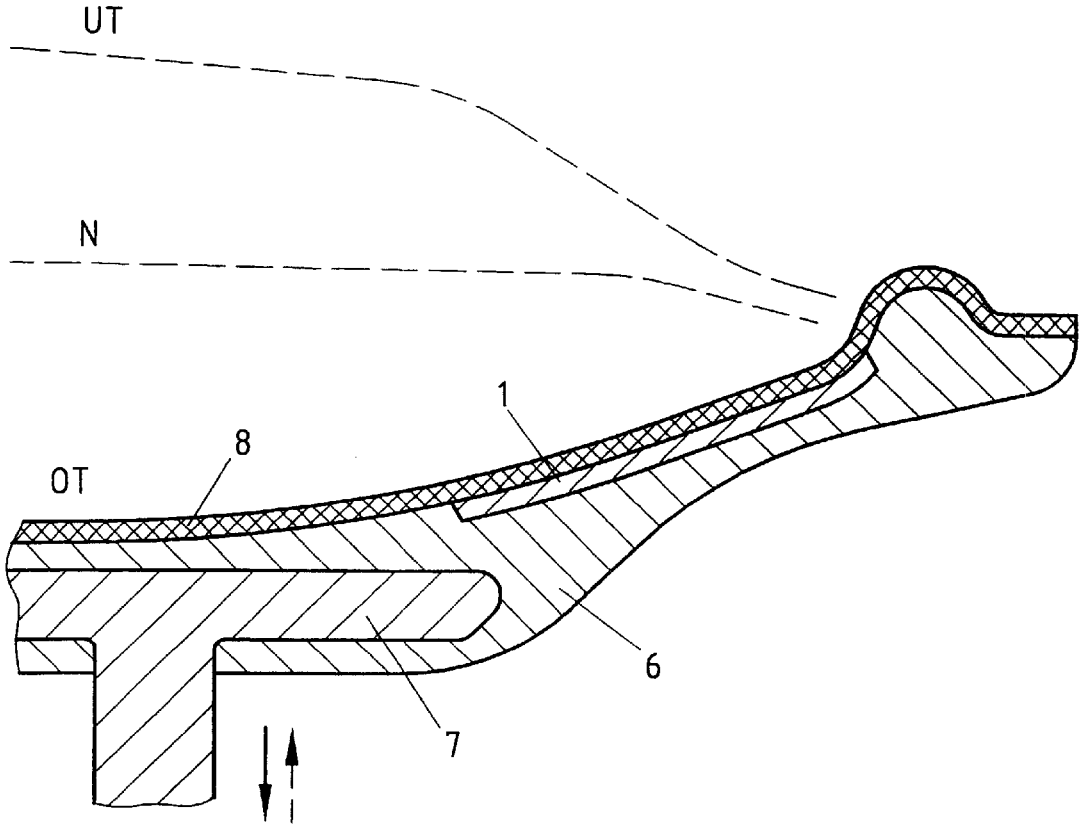
FIG. 2 depicts a partial cutaway view of a mechanically actuated diaphragm having a resistance device.

In FIG. 2, a partial cutaway view is depicted of a mechanically actuated diaphragm. Rubbery-elastic diaphragm plate 6 is periodically deflected by a metal flange 7. OT designates an upper dead center, UT designates a lower dead center, and N designates the neutral position of the diaphragm. As the cutaway view shows, resistance device 1 is secured to the rubbery-elastic diaphragm. A protective layer 8 protects the diaphragm and resistance device 1 from the delivery fluid.

Figure 3:
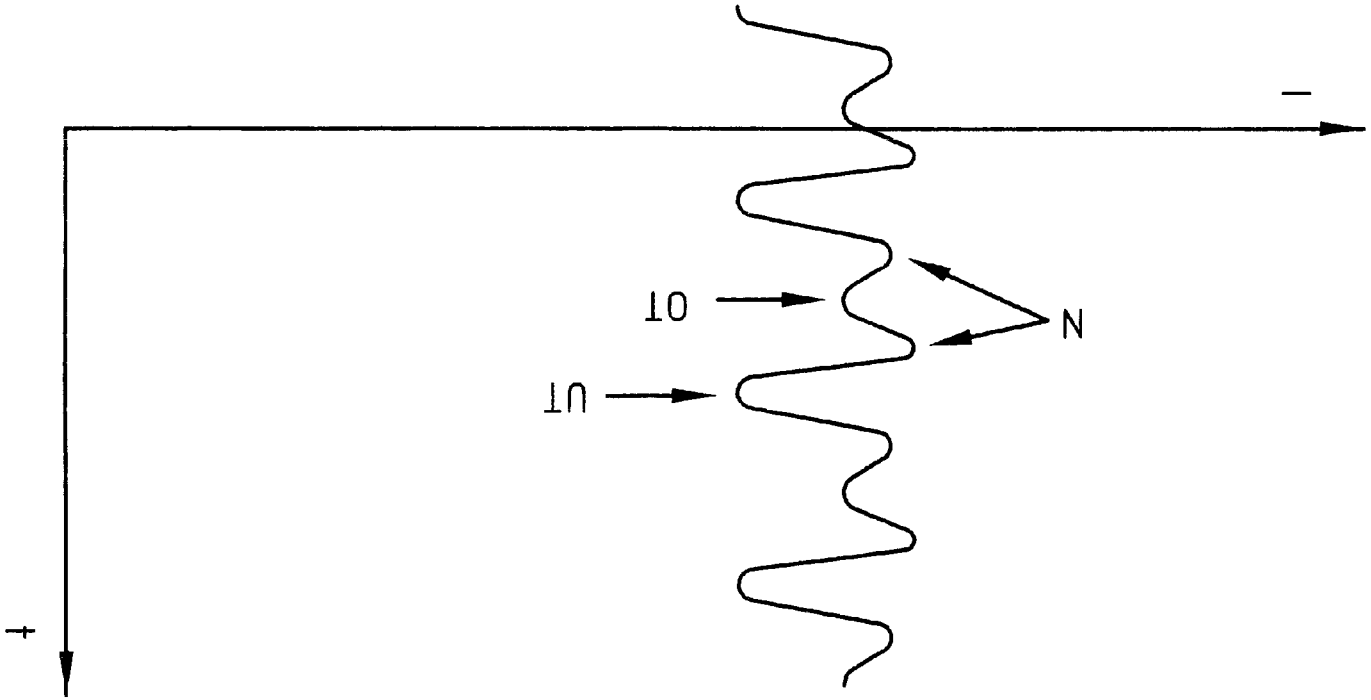
FIG. 3 depicts a measuring protocol for the conductivity curve of a resistance device mounted on a diaphragm, depicted as the electrical current curve as a function of time.

In FIG. 3, the time-dependent quantity that is measured at shunt 2 is depicted. The measurement depicts the electrical currents passing through shunt 2 as a pulsating quantity. In this context, the periodic deflection of the diaphragm corresponds to the maximum and minimum values in the pulsating quantity. UT designates the lower dead center of the diaphragm, OT designates the upper dead center of the diaphragm, and N designates the neutral phase of the diaphragm.

Figure 4:
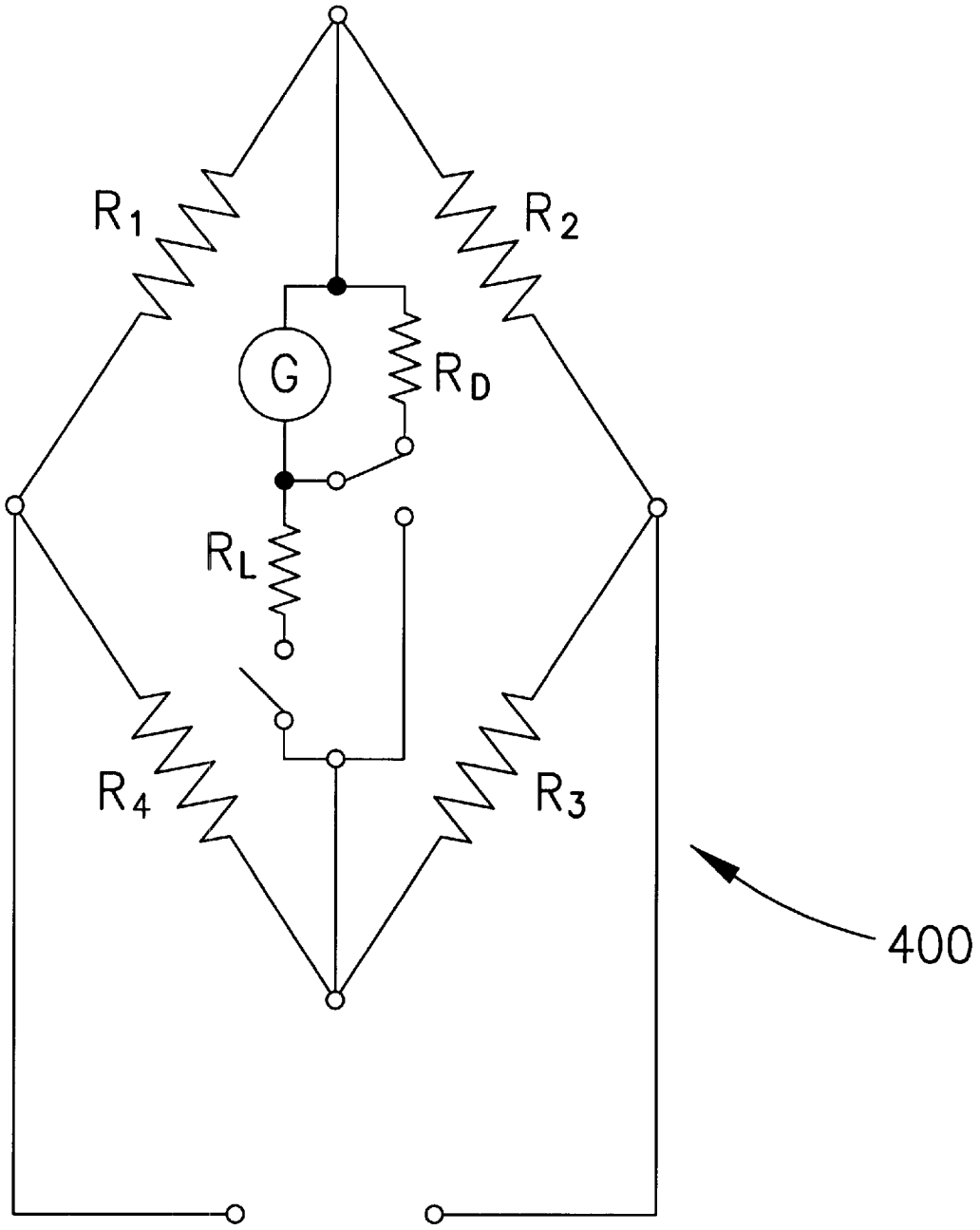
Fig. 4 (PRIOR ART)
FIG. 4 is a schematic representation of a Wheatston bridge as known in the art.

In FIG. 4, a Wheatston bridge 400 is demonstrated for use with the invention as previously described.

What is claimed is:

1. A method for measuring the pump operating parameters of a diaphragm delivery unit, comprising the steps of:

engaging a diaphragm such that movement of the diaphragm results in a pumping action in the diaphragm delivery unit;

measuring the conductivity of a resistance device mounted on the diaphragm over at least one pumping period as a time-dependent quantity; and using said quantity for measuring the operating parameters of the diaphragm delivery unit.

2. The method according to claim 1, wherein the resistance device is an elastomer conductive loop.

3. The method according to claim 2, wherein the elastomer conductive loop is connected in at least one bridge arm of a Wheatston bridge, and the time-dependent quantity is obtained from a measuring voltage in a diagonal arm of the Wheatston bridge.

4. The method according to claim 2, wherein the elastomer conductive loop is connected in series to a shunt, and the time-dependent quantity is obtained from a measuring voltage at the shunt.

5. The method according to claim 3, wherein the pumping frequency is ascertained from an alternating component of the measuring signal.

6. The method according to claim 4, wherein the pumping frequency is ascertained from an alternating component of the measuring signal.

7. The method according to claim 5, wherein the delivery pressure is ascertained from the amplitude of the alternating component.

8. The method according to claim 6, wherein the delivery pressure is ascertained from the amplitude of the alternating component.

9. The method according to claim 3, wherein the time-dependent quantity is obtained by forming an average value and is used for monitoring the diaphragm for damage.

10. The method according to claim 4, wherein the time-dependent quantity is obtained by forming an average value and is used for monitoring the diaphragm for damage.

11. A device for carrying out the method according to claim 1, comprising an elastomer conductive loop mounted on a diaphragm of a diaphragm delivery unit and connected in a bridge arm of a Wheatston bridge or in series to a shunt, wherein a change in the operating state of the diaphragm brings about a temporal change in the measuring voltage in the bridge arm or at the shunt.

* * * * *